US009174467B2

(12) United States Patent
Ohashi

(10) Patent No.: US 9,174,467 B2
(45) Date of Patent: Nov. 3, 2015

(54) PRINTER AND PRINTER CONTROL METHOD

(71) Applicant: SEIKO EPSON CORPORATION, Tokyo (JP)

(72) Inventor: Kazuyoshi Ohashi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/287,879

(22) Filed: May 27, 2014

(65) Prior Publication Data

US 2015/0035890 A1 Feb. 5, 2015

(30) Foreign Application Priority Data

Aug. 5, 2013 (JP) ..... 2013-162064

(51) Int. Cl.
*B41J 13/00* (2006.01)
*B41J 23/02* (2006.01)

(52) U.S. Cl.
CPC ..... *B41J 13/0009* (2013.01); *B41J 13/0054* (2013.01); *B41J 23/025* (2013.01)

(58) Field of Classification Search
CPC ..... B41J 23/025
See application file for complete search history.

(56) References Cited

U.S. PATENT DOCUMENTS

| | | | | |
|---|---|---|---|---|
| 5,893,020 | A * | 4/1999 | Atsumi | 399/364 |
| 2001/0022422 | A1* | 9/2001 | Tamura | 271/10.03 |
| 2005/0063761 | A1* | 3/2005 | Matsushima et al. | 400/629 |
| 2005/0179191 | A1* | 8/2005 | Vernetti et al. | 271/4.1 |
| 2005/0275150 | A1* | 12/2005 | Cook et al. | 271/109 |
| 2009/0166964 | A1 | 7/2009 | Fukasawa | |

FOREIGN PATENT DOCUMENTS

| | | | |
|---|---|---|---|
| JP | 2007045536 A | * | 2/2007 |
| JP | 2009-155037 A | | 7/2009 |

* cited by examiner

*Primary Examiner* — Shelby Fidler
(74) *Attorney, Agent, or Firm* — Global IP Counselors, LLP

(57) ABSTRACT

A printer includes a media stacking section, a print section, a pickup roller, a relay roller, a common actuator, a transport mechanism section and a control section. The control section is configured to control the common actuator based on a print job and displacement of the printing media. The control section is configured to stop transferring of driving force of the common actuator from the pickup roller to an $n^{th}$ printing medium after the pickup roller draws out the $n^{th}$ printing medium and the relay roller starts to send out the $n^{th}$ printing medium which is drawn out in a case where a print job, where printing is carried out on n of the printing media with a length in a transport direction shorter than a transport distance of the printing media from the pickup roller to the print section, is processed in the continuous transport mode.

7 Claims, 7 Drawing Sheets

PRINTER AND PRINTER CONTROL METHOD

CROSS-REFERENCE TO RELATED APPLICATIONS

This application claims priority to Japanese Patent Application No. 2013-162064 filed on Aug. 5, 2013. The entire disclosure of Japanese Patent Application No. 2013-162064 is hereby incorporated herein by reference.

BACKGROUND

1. Technical Field

The present invention relates to a printer and a printer control method.

2. Related Art

Printers in the prior art are provided with a pickup roller which draws out sheets which are stacked one sheet at a time and a relay roller which sends out the sheets which are drawn out by the pickup roller to a print section. The print section is provided with a sensor which detects the passing of an edge of the sheet, a transport roller which transports the sheet with the position of the edge of the sheet which is detected by the sensor as a reference, and a print head which carries out printing on the sheet which is transported by the transport roller. In recent years, printers which operate in a so-called continuous transport mode, where transporting of the succeeding sheet starts before printing on the preceding sheet is complete, are widespread and the time which is necessary to print a plurality of sheets is shortened (Japanese Unexamined Patent Application Publication No. 2009-155037).

SUMMARY

Here, it is possible to reduce manufacturing costs of the printer by the pickup roller, the relay roller, and the transport roller being driven using one motor, but there is the following problem in the continuous transport mode in a case where the sheet transport distance from the pickup roller to the print section exceeds the length of the sheet. (Here, the interval between the preceding and succeeding sheets which are transported is ignored in order for easier understanding.)

At a point in time when the rear edge of one of the sheets reaches the print section during printing, the pickup roller starts transporting of the sheet which follows the succeeding sheet if the pickup roller, the relay roller, and the transport roller are rotated simultaneously using one motor in the continuous transport mode in a case where the sheet transport distance from the pickup roller to the print section exceeds the length of the sheet. Accordingly, a sheet where printing is not carried out in a print job is unintentionally drawn out by the pickup roller even when the pickup roller is stopped at a point in time when the rear edge of the sheet, which is the $n-1^{th}$ sheet in a print job where printing is carried out on n of the sheets, reaches the print section. On the other hand, continuous transporting is interrupted between the $n-1^{th}$ sheet and the $n^{th}$ sheet when the pickup roller is stopped at a point in time when the rear edge of the sheet, which is the $n-2^{th}$ sheet in a print job where printing is carried out on n of the sheets, reaches the print section.

Accordingly, it is imperative that a lower limit according to the transport distance be provided for the length of the sheet which is able to be used in the continuous transport mode in order to prevent such a problem before it happens in the printers in the prior art. In addition, if the lower limit of the length of the sheet which is able to be used in continuous transport mode is set to the length of a standard sheet with a high frequency of use, the sheet transport distance from the pickup roller to the print section is restricted according to the length of the standard sheet. On the other hand, it is necessary that the sheet transport distance from the pickup roller to the print section be lengthened according to the length of the sheet so that double-sided printing is possible.

The present invention has been created in order to solve such a problem and has an object of providing a printer where all sheets which are used in a print job are continuously transported irrespective of the length of the sheets or the transport distance of the sheets.

(1) A printer which is for achieving the object described above is provided with a media stacking section where printing media are stacked, a print section which is provided with a transport roller which transports the printing media and a print head which prints on the printing media which are transported by the transport roller, a pickup roller which draws out the printing media from the media stacking section, a relay roller which is arranged at a position between the pickup roller and the transport roller and sends out the printing media which are drawn out by the pickup roller to the print section, a common actuator which drives the pickup roller, the relay roller, and the transport roller, a transport mechanism section which transfers the driving force of the common actuator to the printing media via the pickup roller, the relay roller, and the transport roller, and a control section which controls the common actuator based on a print job and displacement of the printing media where, in a period of time when printing is being carried out on a certain printing medium by the print section, other printing media are transported using the pickup roller and the relay roller in a continuous transport mode, wherein the control section stops transfer of the driving force of the common actuator from the pickup roller to an $n^{th}$ printing medium after the pickup roller draws out the $n^{th}$ printing medium and the relay roller starts to send out the $n^{th}$ printing medium which is drawn out in a case where a print job, where printing is carried out on n of the printing media (where n is an integer of two or more) with lengths in the transport direction shorter than the transport distance of the printing media from the pickup roller to the print section, is processed in the continuous transport mode.

Due to the present invention, the printing media are transported by the pickup roller, the relay roller, and the transport roller which are driven using the one common actuator. Then, the printing media which are not used in a print job are not drawn out by the pickup roller irrespective of the length of the printing media or the transport distance in a case where the printing media are transported in the continuous transport mode in a print job with n of the printing media since, before the pickup roller completes drawing out of the printing medium where printing is carried out last in one print job, transferring of the driving force of the common actuator from the pickup roller to the printing medium which is last is stopped. In addition, it is possible to continuously transport all of the printing media which are used in a print job to the print section since transferring of the driving force of the common actuator from the pickup roller to the printing medium which is last is stopped after the relay roller starts to send out the printing medium which is last.

(2) The printer which achieves the object described above wherein, when the transport distance of the printing media from the pickup roller to the print section is X, the interval between the printing media which line up and are transported as preceding and succeeding printing media in the continuous transport mode is Y, the length of the printing media in the transport direction is Z and N is a quotient X/(Y+Z), the control section may stop transferring of the driving force of the common actuator from the pickup roller to the $n^{th}$ printing medium before the rear edge of an $(n-N)^{th}$ printing medium reaches the print section.

In a case where this configuration is adopted, it is possible to continuously transport all of the printing media which are used in a print job to the print section without the printing media which are not used in the print job being drawn out by the pickup roller even when the transport distance of the printing media is equal to or more than double the length of the printing media.

(3) The printer which achieves the object described above which further has a measuring section which measures displacement of the printing media, wherein the measuring section is provided with a sensor which detects passing of an edge of the printing media at a position between the relay roller and the transport roller and the control section may drive the transport roller with the position where the sensor detects the edge of the printing media as a reference, alternately repeat transporting of the printing media using the transport roller and driving of the print head, determine whether or not the $n^{th}$ printing medium has reached the position of being sent out by the relay roller when the one of the printing media is in the process of being transported, determine whether or not the rear edge of the one of the printing media has passed the sensor when the one of the printing media is in the process of being transported in a case when it is determined that the $n^{th}$ printing medium has not reached the position of being sent out by the relay roller even when the one of the printing media is in the process of being transported, and execute splitting the process of being transported into two parts of prior transporting where the rear edge of the one of the printing media has not reached the sensor and latter transporting where the rear edge of the one of the printing media has passed the sensor as well as stopping transferring of the driving force of the common actuator from the pickup roller to the $n^{th}$ printing medium between the prior transporting and the latter transporting in a case when it is determined that the rear edge of the one of the printing media has passed the sensor when the one of the printing media is in the process of being transported.

Since it is possible for displacement of the printing media to be detected using the sensor which is fixed at a position which is close to the print section in a case where this configuration is adopted, it is possible to switch processes from transporting to the print section to printing in the print section at a precise timing and it is possible to precisely control the position of the printing media during printing. In addition, it is possible to stop transferring of the driving force of the common actuator from the pickup roller to the printing media reliably at an appropriate timing while using the sensor to grasp the number of the printing media on which printing has been carried out.

(4) The printer which achieves the object described above wherein the print section may be provided with a carriage which moves back and forth in a direction which is orthogonal to the transport direction of the printing media by being mounted on the print head which discharges ink droplets, the transport mechanism section may have a switching mechanism which switches between a state where the driving force is transferred from the common actuator to the pickup roller and a state where the driving force is not transferred from the common actuator to the pickup roller and which interrupts transferring of the driving force from the common actuator to the pickup roller by abutting with the carriage at a prescribed position and moving along with the carriage, and the control section may stop transferring of the driving force of the common actuator to the pickup roller by moving the carriage to pass the prescribed position.

In regard to the necessary of having a means which switches between a state where the driving force is transferred from the common actuator to the pickup roller and a state where the driving force is not transferred from the common actuator to the pickup roller, it is possible to reduce manufacturing costs of the printer a case when using the present invention since a dedicated actuator for this switching operation is not necessary in a serial ink jet printer which adopts this configuration.

(5) The printer which achieves the object described above wherein the control section may discharge ink droplets from the print head in both of a first period when the carriage is moved in a first direction and a second period when the carriage is moved in a second direction which is the opposite orientation to the first direction, set a stopping flag in a case where it is determined that the $n^{th}$ printing medium reaches the position of being sent out by the relay roller when the one of the printing media is in the process of being transported, determine whether or not the movement direction of the carriage when transporting the current and previous certain printing media is a direction where the carriage is approaching the switching mechanism when the one of the printing media in the process of being transported, and move the carriage to pass the prescribed position before the one of the printing media in the process of being transported is transported in a case where it is determined that the movement direction of the carriage is the direction where the carriage is approaching the switching mechanism.

In a serial ink jet printer where this configuration is adopted, it is possible to shorten the time for printing since so-called bidirectional printing is performed. Furthermore, it is possible to shorten the time for printing since it is possible to shorten the distance which the carriage moves in order to switch between a state where the driving force is transferred from the common actuator to the pickup roller and a state where the driving force is not transferred from the common actuator to the pickup roller in a serial ink jet printer which adopts this configuration.

BRIEF DESCRIPTION OF THE DRAWINGS

Referring now to the attached drawings which form a part of this original disclosure.

DETAILED DESCRIPTION OF EXEMPLARY EMBODIMENTS

Figure 1:
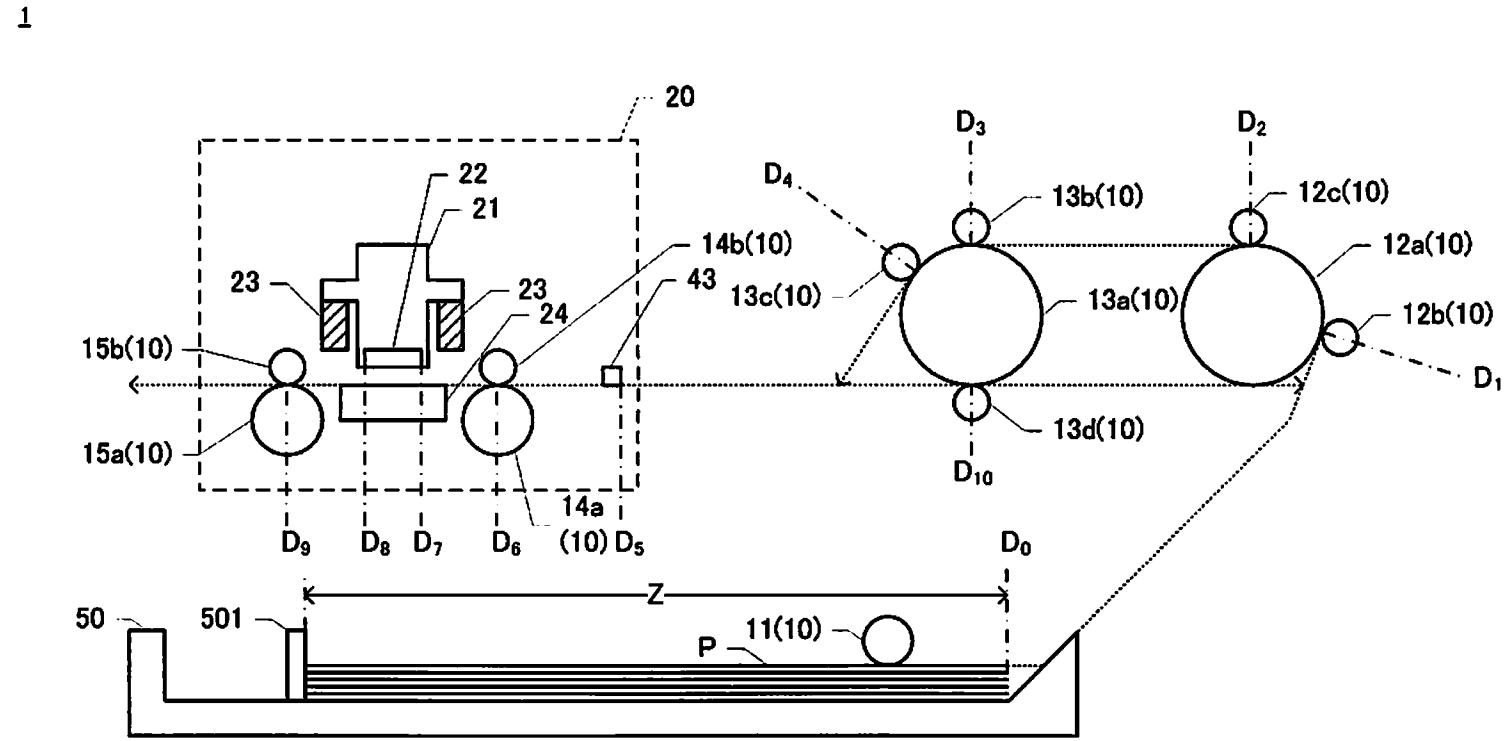
FIG. 1 is a schematic diagram related to an embodiment of the present invention.

Below, an embodiment of the present invention will be described with reference to the attached drawings. Here, the same reference numerals are given to the constituent elements which correspond in each of the diagrams and overlapping descriptions are omitted.

1. Overview of Printer

Figure 2:
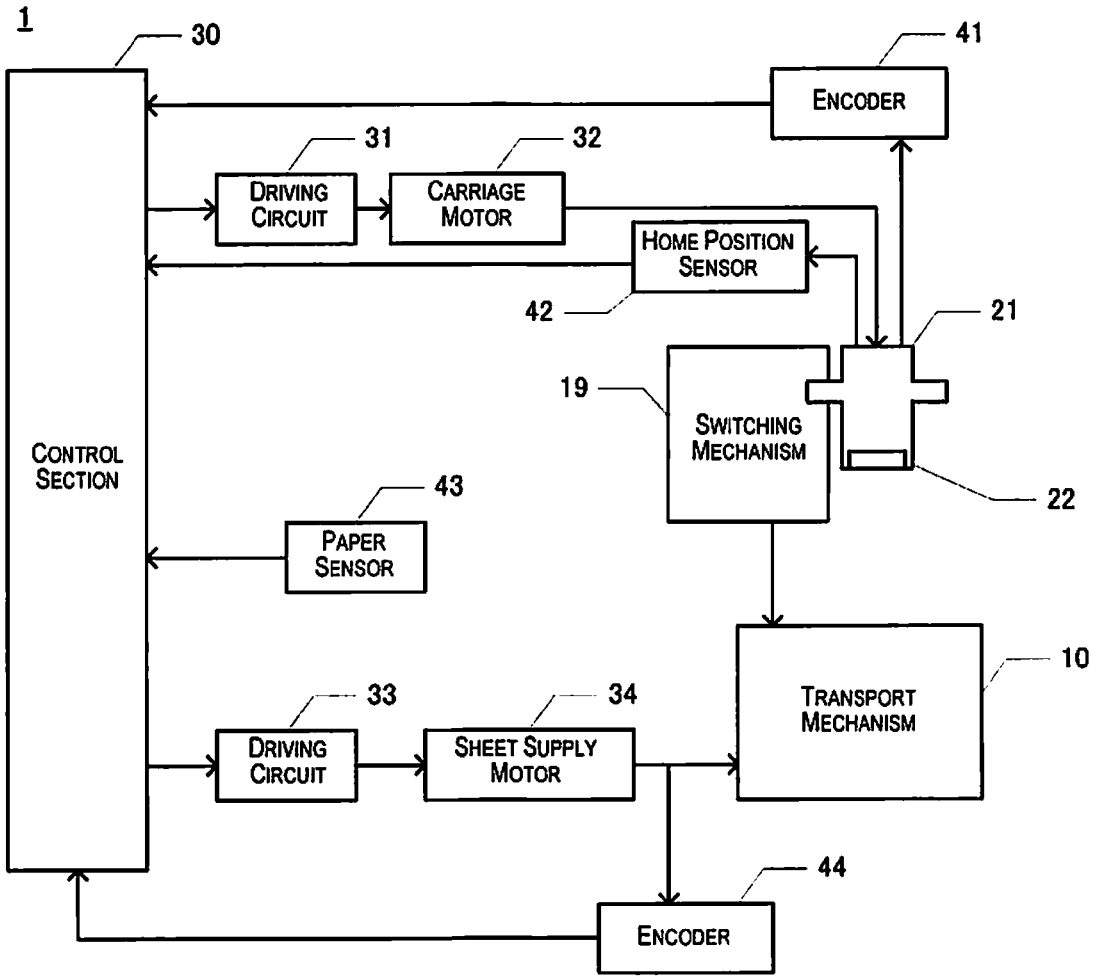
FIG. 2 is a block diagram related to an embodiment of the present invention.

A configuration of a printer 1 which is an embodiment of the present embodiment is illustrated in FIG. 1 and FIG. 2. The printer 1 is a serial ink jet type of printer which executes a print job by sending out sheets P which are printing media which are stacked in a sheet supply cassette 50 one sheet at a time between a platen 24 and a print head 22 using a transport mechanism 10.

2. Printer Configuration

The sheet supply cassette 50 which is a media stacking section is a box for stacking a plurality of the sheets P. The sheet supply cassette 50 is accommodated in the printer body which is not shown in the diagram to be able to be inserted and removed to and from the printer body. A slider 501 is provided in the sheet supply cassette 50. It is possible to align and hold, for example, sheets from photo (89 mm×127 mm) size to A3 size in the sheet supply cassette 50 by the slider 501 being moved according to the size of the sheets.

The transport mechanism 10 includes a pickup roller 11, relay rollers 12*a* and 13*a*, a sheet feeding roller 14*a*, a sheet discharge roller 15*a*, a gear train not shown in the diagram which transfers the driving force from a sheet supply motor 34 which is a common actuator to the rollers, and a switching mechanism 19 which forms a portion of the gear train which transfers the driving force from the sheet supply motor 34 to the pickup roller 11.

A rotation shaft of the pickup roller 11 is attached to an arm which is not shown in the diagram and the pickup roller 11 comes into contact with the upper surface of the sheets P which are stacked in the sheet supply cassette 50. The pickup roller 11 sends out the sheets P toward the relay roller 12*a* by being driven by the sheet supply motor 34 in a counterclockwise direction in FIG. 1. The sheet supply motor 34 is driven by a driving circuit 33 which is controlled by a control section 30.

The relay rollers 12*a* and 13*a* send out the sheets P toward the sheet feeding roller 14*a* by being driven by the sheet supply motor 34 in a counterclockwise direction in FIG. 1. Driven rollers 12*b* and 12*c*, which come into contact with the relay roller 12*a* and rotate along with the relay roller 12*a*, are provided in the periphery of the relay roller 12*a* which is provided at the upstream side of a sheet supply path. Driven rollers 13*b*, 13*c*, and 13*d*, which come into contact with the relay roller 13*a* and rotate along with the relay roller 13*a*, are provided in the periphery of the relay roller 13*a* which is provided at the downstream side of the sheet supply path. The sheets P are sent out toward the sheet feeding roller 14*a* by being pinched by the relay rollers 12*a* and 13*a* and by the driven rollers 12*b*, 12*c*, 13*b*, and 13*c*.

The sheet feeding roller 14*a* which is a transport roller rotates along with a driven roller 14*b* by being driven by the sheet supply motor 34 in a counterclockwise direction in FIG. 1 and sends out the sheets P which are pinched between the sheet feeding roller 14*a* and the driven roller 14*b* toward the sheet discharge roller 15*a*. The sheet discharge roller 15*a* rotates along with a driven roller 15*b* by being driven by the sheet supply motor 34 in a counterclockwise direction in FIG. 1 and sends out the sheets P which are pinched between the transport roller 15*a* and the driven roller 15*b* onto a stacker which is not shown in the diagram.

A carriage 21 where the print head 22 is mounted and the platen 24 are provided between the sheet feeding roller 14*a* and the sheet discharge roller 15*a*. A discharge port which is not shown in the diagram and which discharges ink droplets is formed in the print head 22. The carriage 21 is supported on a guide rail 23 to be able to move back and forth in a direction which is orthogonal with regard to the transport direction of the sheets P. The carriage 21 moves along the guide rail 23 due to rotation of a carriage motor 32. The carriage motor 32 is driven by a driving circuit 31 which is controlled by the control section 30. Displacement of the carriage 21 is detected using a linear encoder 41 which measures displacement of the carriage 21 and a home position sensor 42 which detects the carriage 21 at a home position.

Displacement of the sheets P is measured using a rotary encoder 44, which measures the rotation angle of the sheet supply motor 34, and a sheet sensor 43. That is, the rotary encoder 44 and the sheet sensor 43 configure a measuring section. The sheet sensor 43 is provided in the vicinity of the upstream side of the sheet feeding roller 14*a*. The sheet sensor 43 is an optical sensor which detects changes in the amount of light incident on the sheet sensor 43 which accompanies passing of the sheets P. It is possible to switch between a sheet supply process and a print process at a precise timing by using the sheet sensor 43 which is fixed at a position in the vicinity of the upstream side of the platen 24, and it is possible to precisely control the position of the sheets P during printing. In addition, it is possible to stop transferring of the driving force from the sheet supply motor 34 to the pickup roller 11 reliably at an appropriate timing while grasping the number of sheets P on which printing has been carried out. Here, the sheet sensor 43, the sheet feeding roller 14*a*, the sheet discharge roller 15*a*, the print head 22, the platen 24, and the like are elements which configure the print section 20 which is shown in FIG. 2.

The control section 30 is a computer which is provided with a processor, a memory, a ROM, an inputting and outputting circuit, and the like which are not shown in the diagram. The control section 30 controls the carriage motor 32, the sheet supply motor 34, and the print head 22 in accordance with a sequence which is determined in advance by the processor executing a control program by reading the control program from the ROM into the memory. Printing is carried out on the sheet P by alternately repeating sub-scanning where the sheet P is transported to a prescribed position and main scanning where ink is discharged from the print head 22 at a specific timing while the print head 22 is moving. Then, the time for printing is shortened by the control section 30 executing so-called bidirectional printing. That is, using the control section 30, ink droplets are not only discharged from the print head 22 while the carriage 21 is moving in a direction of moving away from the home position, but ink droplets are also discharged from the print head 22 while the carriage 21 is moving in a direction of approaching the home position.

A guide which is not shown in the diagram is provided in the printer 1 in order to transport the sheets P along a transport path which is shown by a dotted line in FIG. 1. Here, an origin $D_0$ and waypoints $D_1$, $D_2$, $D_3$, $D_4$, $D_5$, $D_6$, $D_7$, $D_8$, $D_9$, and $D_{10}$ are set as follows in the transport path of sheets P.

$D_0$: front edge of the sheet P which is held in the sheet supply cassette 50

$D_1$: contact point of the relay roller 12*a* and the driven roller 12*b*

$D_2$: contact point of the relay roller 12*a* and the driven roller 12*c*

$D_3$: contact point of the relay roller 13*a* and the driven roller 13*b*

$D_4$: contact point of the relay roller 13*a* and the driven roller 13*c*

$D_5$: detection position of the sheet sensor 43

$D_6$: contact point of the sheet feeding roller 14*a* and the driven roller 14*b*

$D_7$: position of the discharge port on the farthest upstream side of the print head 22

$D_8$: position of the discharge port on the farthest downstream side of the print head 22

$D_9$: contact point of the sheet discharge roller 15*a* and the driven roller 15*b*

$D_{10}$: contact point of the relay roller 13*a* and the driven roller 13*d*

Here, a contact point is a contact point in a state where the sheet P is not being transported and is a nip point where the sheet P is transported by being pinched in a state where the sheet P is being transported.

In addition, the length of the sheets in the transport direction is expressed as Z, the length of the sheet which is an A3 size in the translation direction is expressed as $Z_3$, a transport segment from $D_n$ to $D_m$ is expressed as $D_n/D_m$, and the distance from $D_n$ to $D_m$ is expressed as $|D_n/D_m|$. The transport mechanism 10 transfers the driving force of the sheet supply motor 34 to the pickup roller 11, the relay rollers 12*a* and 13*a*, the sheet feeding roller 14*a*, and the sheet discharge roller 15*a* during double-sided printing so that the rear edge of the sheet P passes in the order of $D_{10}$, $D_1$, $D_2$, $D_3$, $D_4$, $D_5$, $D_6$, $D_7$, $D_8$, and $D_9$ after the front edge of the sheet P has passed in the order of $D_1$, $D_2$, $D_3$, $D_4$, $D_5$, $D_6$, $D_7$, $D_8$, and $D_9$. Accordingly, the printer 1 is able to carry out double-sided printing with regard to the sheets which satisfy the following equation.

$$|D_5/D_{10}|+|D_{10}/D_1|+|D_1/D_5|>Z$$

Double-sided printing is possible in the printer 1 with regard to the sheets P where the following equation is established and which are A3 size or smaller.

$$|D_5/D_{10}|+|D_{10}/D_1+|D_1/D_5|>Z$$

As a result, the transport segment $D_0/D_5$ is longer than the length of the sheet with an A4 size. That is, the sheet P does not reach $D_5$ which is the detection point of the sheet sensor 43 even when transporting one of the sheets where the length of the sheet is an A4 size.

Accordingly, the control section 30 stops transferring of the driving force of the sheet supply motor 34 from the pickup roller 11 to the sheet P in the continuous transport mode before the last of the sheets P in a print job reaches $D_5$ which is the detection point of the sheet sensor 43 in order for the sheet P which is not used in the print job to not be drawn out downstream more than the origin Do when the print job is complete. In addition, the control section 30 continues transferring of the driving force of the sheet supply motor 34 from the pickup roller 11 to the sheet P in the continuous transport mode until the last of the sheets P reaches $D_1$ which is the contact point of the relay roller 12*a* and the driven roller 12*b* in order for the sheets P to be continuously transported from the first to the last of the sheets in the print job.

The switching mechanism 19 is configured so as to maintain either state of a state where the driving force of the sheet supply motor 34 is transferred to the pickup roller 11 or a state where the driving force of the sheet supply motor 34 is not transferred to the pickup roller 11.

Figure 7A:
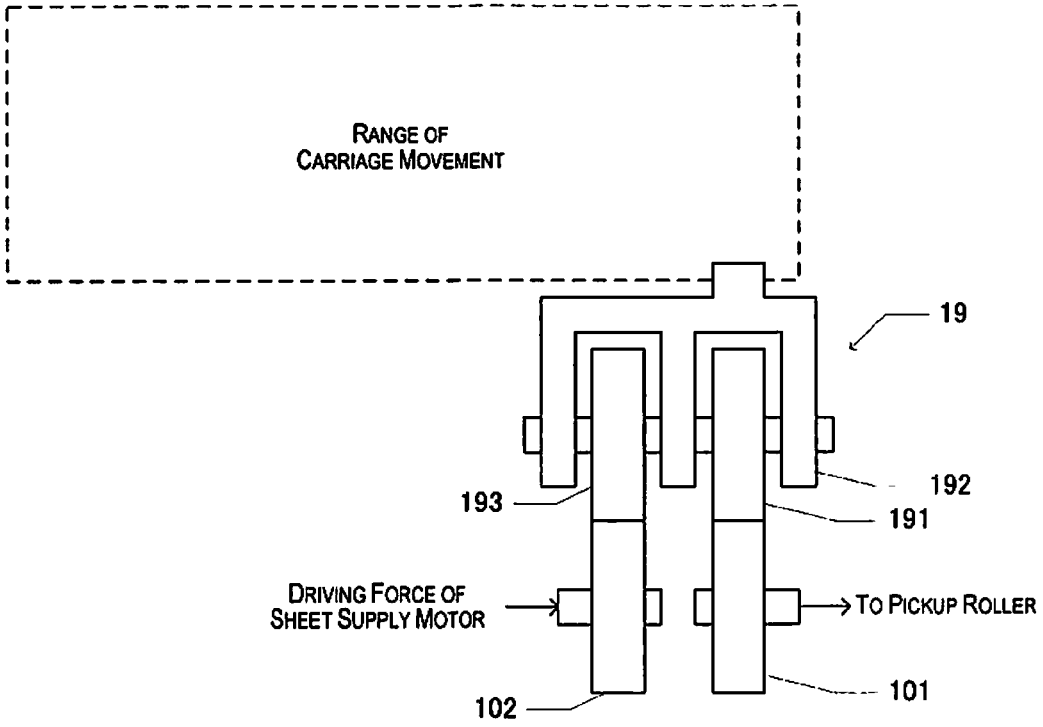
FIGS. 7A and 7B are schematic diagrams illustrating a switching mechanism related to an embodiment of the present invention.
Figure 7B:
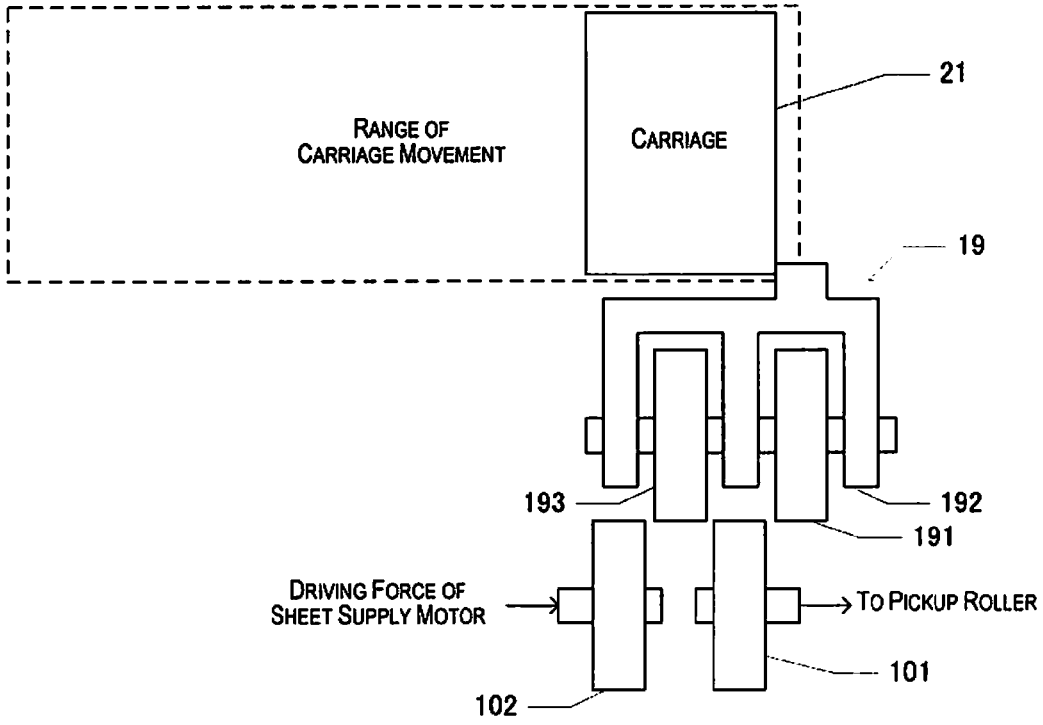

The switching mechanism 19 is shown in FIGS. 7A and 7B. The switching mechanism 19 is provided with gears 191 and 193 for continuing or interrupting a transfer path of the driving force from the sheet supply motor 34 to the pickup roller 11 and a holding section 192 which holds the rotation shafts of the gears 191 and 193.

The gears 191 and 193 are fixed to a rotation shaft which is shared. The holding section 192 is supported to be parallel with the carriage 21 so as to be able to move. The holding section 192 is pressed by a spring which is not shown in the diagram in a direction toward an edge section which is on the opposite side to the home position (a direction to the left in FIGS. 7A and 7B) and is at a position which is shown in FIG. 7A in the vicinity of the home position in a state of being of not being in contact with the carriage 21. In the state which is shown in FIG. 7A where the holding section 192 is not in contact with the carriage 21, the gear 191 meshes with a gear 101 which always transfers torque to the pickup roller 11 and the gear 193 meshes with a gear 102 which always transfers torque from the sheet supply motor 34. Accordingly, the driving force of the sheet supply motor 34 is transferred to the pickup roller 11 in the state which is shown in FIG. 7A where the holding section 192 is not in contact with the carriage 21.

A portion of the holding section 192 protrudes into the range of the movement of the carriage 21 toward a region of the edge section on the home position side. As a result, the carriage 21 abuts with the holding section 192 when moving to the prescribed position toward the home position. The holding section 192 engages with an engaging mechanism which is not shown in the diagram when moving to the prescribed position which is shown in FIG. 7B by being pressed by the carriage 21. The gear 191 is separated from the gear 101 which transfers torque to the pickup roller 11 in a state which is shown in FIG. 7B where the holding section 192 is engaged with the engaging mechanism. Accordingly, the driving force of the sheet supply motor 34 is not transferred to the pickup roller 11 in the state in FIG. 7B where the holding section 192 is engaged with the engaging mechanism.

The engaging mechanism which is not shown in the diagram releases the holding section 192 when the holding section 192 is further pressed to a direction to the left of the position, which is shown in FIG. 7B, on the paper of the diagram due to the carriage 21. After this, the holding section 192 which is released by the engaging mechanism returns to the state which is shown in FIG. 7A by being pressed by the spring when the carriage 21 moves in the direction toward the edge section which is on the opposite side to the home position (a direction to the left in FIGS. 7A and 7B).

In this manner, it is possible to reduce manufacturing costs of the printer 1 in the present embodiment compared to a case of providing a separate actuator, which switches between a state where the driving force is transferred from the sheet supply motor 34 to the pickup roller 11 and a state where the driving force is not transferred from the sheet supply motor 34 to the pickup roller 11, in order to drive the switching mechanism 19 using the carriage motor 32.

3. Printer Operations

Next, an overview of operations of the printer 1 in a one-sided printing continuous sheet supply mode (a continuous transport mode) will be described with reference to FIG. 3.

The control section 30 rotates the pickup roller 11 and the relay rollers 12*a* and 13*a* by activating the sheet supply motor 34 and transports the first of the sheets to the print section 20 (S1) when a print job, which is set in a one-sided printing continuous sheet supply mode (the continuous transport mode) for sheets with an A4 size, is acquired. At this time, the control section 30 activates the sheet supply motor 34 by setting a target value of the rotation angle, which is in a range where the sheet P sufficiently reaches the detection position of the sheet sensor 43, in the driving circuit 33.

After activating the sheet supply motor 34, the control section 30 continues by determining if the front edge of the sheet P has reached the detection position of the sensor sheet 43 (S2) until the front edge of the sheet P reaches the detection position of the sensor sheet 43.

When it is determined that the front edge of the sheet P has reached the detection position of the sensor sheet 43, the control section 30 executes continuous sheet supply printing (S3). The continuous sheet supply printing is a process where the sheet P which is the next sheet is transported toward the print section 20 by the pickup roller 11 and the relay rollers 12*a* and 13*a* being rotated at the same time as the sheet feeding roller 14*a* and the sheet discharge roller 15*a* are rotated in order to execute printing with regard to one of the sheets P.

Here, the length of the transport segment $|D_0/D_5|$ from the sheet supply cassette 50 to the sheet sensor 43 of the print section 20 satisfies the following relationship when length of the sheet with an A4 size in the transport direction is $Z_1$ and the interval between the preceding and succeeding sheets P which are continuously transported in the one-sided printing continuous sheet supply mode is Y.

$$Y+Z_4<|D_0/D_5|<2(Y+Z_4)$$

Accordingly, the continuous sheet supply printing is performed with regard to the sheets P until the sheet P which is the $n-2^{th}$ sheet which belongs to one print job.

When printing with regard to an arbitrary one of the sheets P which belongs to the one print job is completed, the control section 30 determines if printing is complete with regard to the sheet P which is the $n-2^{th}$ sheet which belongs to the print job (S4). The control section 30 repeats the processes of steps S2, S3 and S4 until printing is completed with regard to the sheet P which is the $n-2^{th}$ sheet which belongs to the print job. Here, during sheet supply printing of the sheet $P_n$ which is the $n^{th}$ sheet which belongs to one print job, Y which is the interval between the preceding and succeeding sheets P which are continuously transported in the continuous sheet supply mode and $|D_5/D_7|$ which is the distance from $D_7$ which is the position of the discharge port on the farthest upstream side of the print head 22 to $D_5$ which is the detection position of the sheet sensor 43 are set to a relationship where the sheet $P_{n+1}$ which is the next sheet does not reach the detection position of the sheet sensor 43 until the rear edge of the sheet $P_n$ which is the $n^{th}$ sheet reaches $D_7$ which is the position of the discharge port on the farthest upstream side of the print head 22.

When it is determined that printing is complete with regard to the sheet P which is the $n-2^{th}$ sheet which belongs to the print job, the control section 30 continues by determining if the front edge of the sheet P has reached the detection position of the sensor sheet 43 (S5) until the front edge of the sheet P which is the next sheet reaches the detection position of the sensor sheet 43. Here, since printing is complete with regard to the sheet P which is the $n-2^{th}$ sheet, it is determined whether or not the front edge of the sheet P which is the $n-1^{th}$ sheet has reached the detection position of the sheet sensor 43.

When it is determined that the front edge of the sheet P which is the $n-1^{th}$ sheet has reached the detection position of the sheet sensor 43, sheet supply printing is performed with regard to the sheet P which is the $n-1^{th}$ sheet (S6). As will be described later, in the sheet supply printing with regard to the sheet P which is the $n-1^{th}$ sheet, the sheet P which is the $n^{th}$ sheet is transported toward the print section 20 by being drawn out from the sheet supply cassette 50 by rotating the pickup roller 11 and the relay rollers 12*a* and 13*a* at the same time as the sheet feeding roller 14*a* is rotated during printing with regard to the sheet P which is the $n-1^{th}$ sheet. However, as will be described later, transferring of the driving force from the pickup roller 11 to the sheet supply motor 34 is stopped before the pickup roller 11 comes into contact with the sheet P (the sheet P which is the $n+1^{th}$ sheet) which does not belong to the print job which is being executed.

When the sheet supply printing of the $n-1^{th}$ sheet is complete, the control section 30 continues by determining if the front edge of the sheet P has reached the detection position of the sensor sheet 43 (S7) until the front edge of the sheet P reaches the detection position of the sensor sheet 43. Here, it is determined whether or not the front edge of the sheet P which is the last sheet has reached the detection position of the sensor sheet 43 since the printing is completed up to printing with regard to the sheet P which is the $n-1^{th}$ sheet.

When it is determined that the front edge of the sheet P which is the last sheet has reached the detection position of the sheet sensor 43, printing is performed with regard to the sheet P which is the last sheet (S8). Since the length of the transport segment $|D_0/D_5|$ from the sheet supply cassette 50 to the sheet sensor 43 of the print section 20 is shorter than $Z_4$ which is length of the sheet with an A4 size and is shorter than $2\times Z_4$, the pickup roller 11 comes into contact with the sheet P which is not a printing target in the print job which is currently being executed in a state where the front edge of the sheet P which is the last sheet has reached the detection position of the sheet sensor 43. Then, the relay rollers 12*a* and 13*a*, the sheet feeding roller 14*a*, and the sheet discharge roller 15*a* are driven by the sheet supply motor 34 during printing with regard to the sheet P which is the last sheet, but the sheet P which is not a printing target in the print job which is currently being executed is not drawn out from the sheet supply cassette 50 since there is a continuation of a state, where transferring of the driving force of the sheet supply motor 34 to the pickup roller 11 is stopped, from during the sheet supply printing with regard to the sheet P which is the $n-1^{th}$ sheet.

Next, the operation of the sheet supply printing with regard to the sheet P which is the $n-1^{th}$ sheet will be described with reference to FIG. 4.

When starting execution of the sheet supply printing of the $n-1^{th}$ sheet, first, the control section 30 executes sheet transporting by driving the sheet supply motor 34 with the initial print position of the sheet P which is the $n-1^{th}$ sheet as a target (S31). At this time, as will be described later, the control section 30 stops transferring of the driving force from the sheet supply motor 34 to the pickup roller 11 according to the target position.

Next, the control section 30 executes main scanning where ink is discharged from the print head 22 once (S32) by driving the print head 22 while moving the carriage 21 in either direction by driving the carriage motor 32. At this time, ink is discharged from the print head 22 in a segment of $D_7/D_8$ which is shown in FIG. 1 with regard to the sheet P which is the $n-1^{th}$ sheet which is stopped on the platen 24.

Next, the control section 30 executes a pickup roller off control (S33). As will be described later, the control section 30 in the pickup roller off control stops transferring of the driving force from the sheet supply roller 34 to the pickup roller 11 according to the state of a pickup roller off flag and the immediately previous movement direction of the carriage 21.

Next, the control section 30 executes sheet transporting by driving the sheet supply motor 34 with the next print position of the sheet P which is the $n-1^{th}$ sheet as a target (S34). At this time, as will be described later, the control section 30 stops transferring of the driving force from the sheet supply motor 34 to the pickup roller 11 according to the target position during transporting of the sheet P.

Next, the control section 30 determines whether or not the trailing edge of the range where printing is possible (the trailing edge of the page) on the sheet P which is the $n-1^{th}$ sheet has reached $D_7$ which is the position of the discharge port on the farthest upstream side of the print head 22 (S35). The control section 30 repeats the process of steps S32 to S35 until the trailing edge of the page reaches $D_7$ which is the position of the discharge port on the farthest upstream side of the print head 22.

When it is determined that the rear edge of the sheet P which is the $n-1^{th}$ sheet reaches $D_7$ which is the position of the discharge port on the farthest upstream side of the print head 22, the control section 30 activates the sheet supply motor 34 and transports the sheet P with a position, where the rear edge of the sheet P which is the $n-1^{th}$ sheet passes the contact point between the sheet discharge roller 15*a* and the driven roller 15*b*, as a target (S36). At this time, the relay rollers 12*a* and 13*a*, the sheet feeding roller 14*a*, and the sheet discharge roller 15*a* are driven when the sheet supply motor 34 is rotated. Then, since transferring of the driving force of the sheet supply motor 34 from the pickup roller 11 to the sheet P is stopped in both step S31 and S32, the pickup roller 11 is not driven even if the sheet supply motor 34 is rotated. The sheet supply printing of the $n-1^{th}$ sheet is completed when the control section 30 activates the sheet supply motor 34 by setting a target value of the rotation angle, which is in a range where the rear edge of the sheet P which is the $n-1^{th}$ sheet sufficient reaches the contact point of the sheet discharge roller 15*a* and the driven roller 15*b*, in the driving circuit 33.

Figure 3:
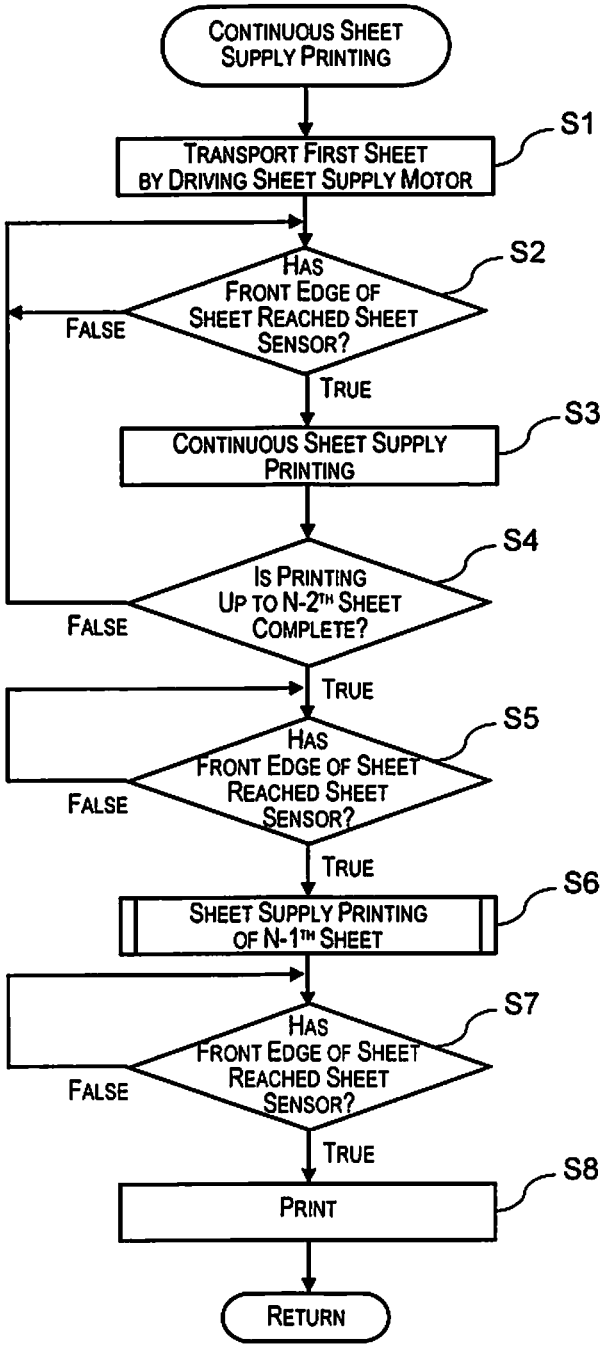
FIG. 3 is a flow chart related to an embodiment of the present invention.

When the sheet supply printing of the sheet P which is the $n-1^{th}$ sheet is completed by activating the sheet supply motor 34 and the sheet P which is the $n^{th}$ (last) sheet reaches the detection position of the sheet sensor 43, the control section 30 starts printing of the sheet P which is the $n^{th}$ sheet since "true" is determined in step S7 which is shown in FIG. 3.

Figure 4:
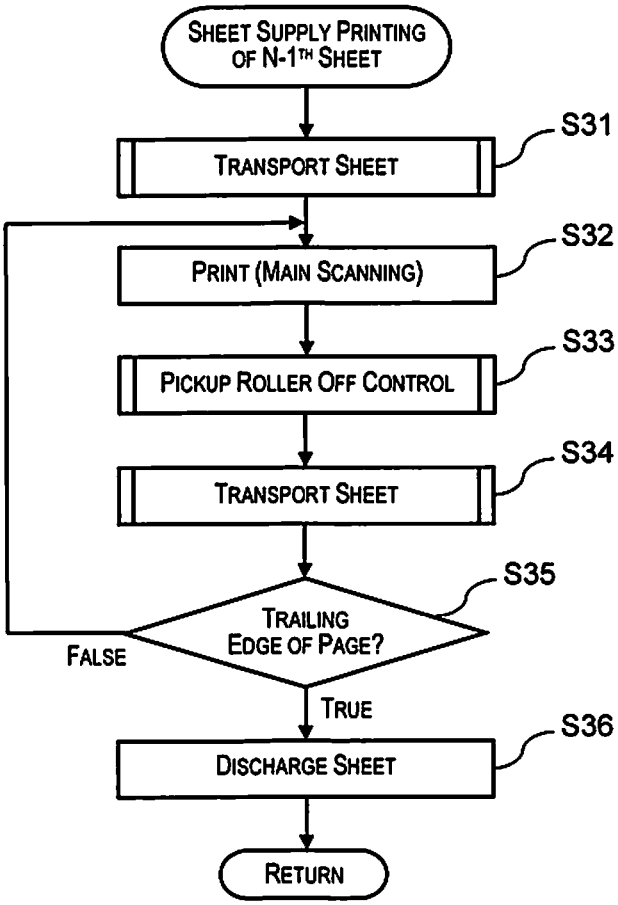
FIG. 4 is a flow chart related to an embodiment of the present invention.
Figure 5:
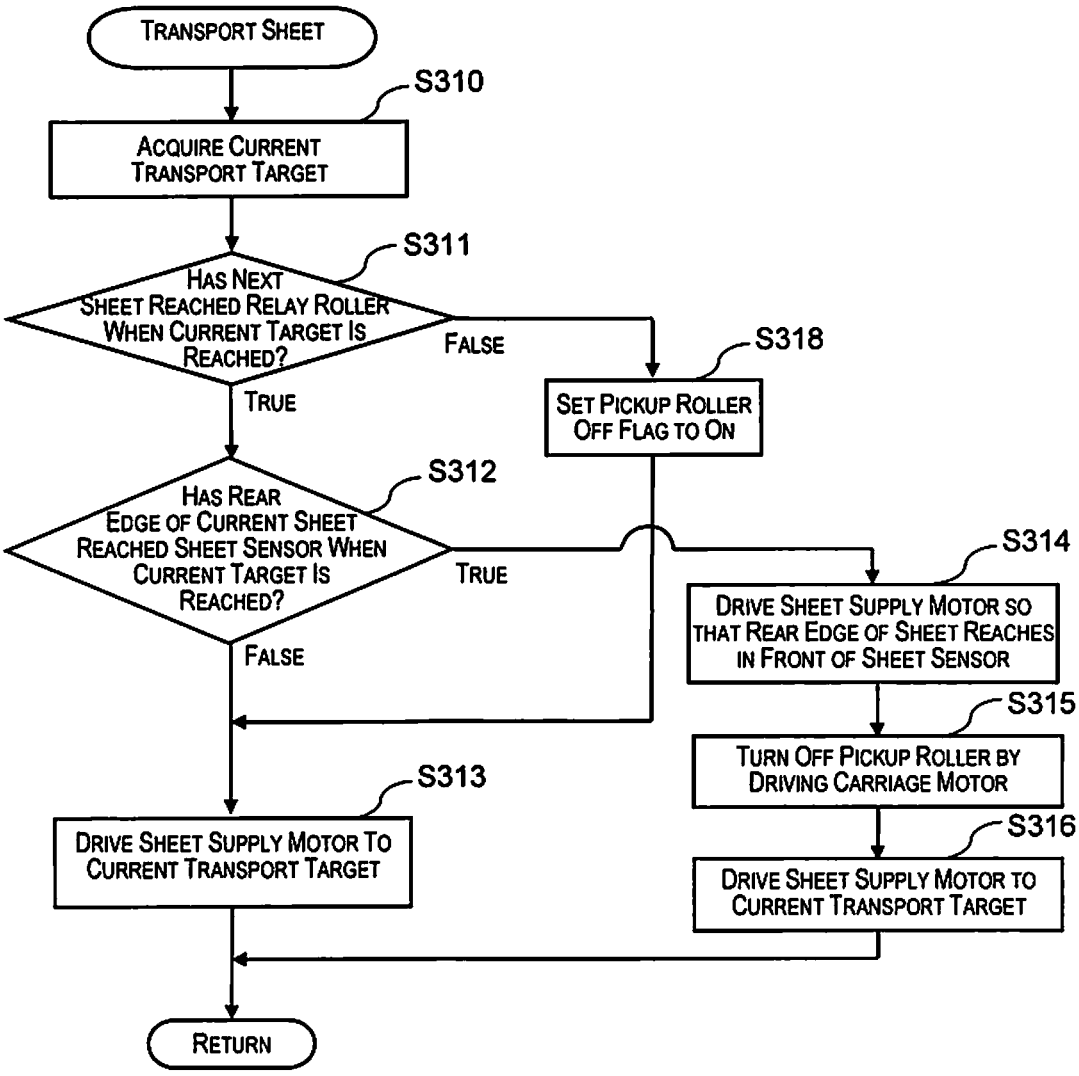
FIG. 5 is a flow chart related to an embodiment of the present invention.

Next, the operation of sheet transporting which is executed in steps S31 and S34 which are shown in FIG. 4 will be described in detail with reference to FIG. 5.

Initially, the control section 30 acquires a current transport target (S310). At this time, the control section 30 acquires a transport target which is a value which indicates the rotation angle of the sheet supply motor 34, but at this point in time, the transport target is not set in the driving circuit 33 of the sheet supply motor 34. Here, the transport target is not only $|D_7/D_8|$ which is the length of the print head 22 in the sub-scanning direction but is different every time according to the content of a printing target page due to the settings of the intervals between lines in the sub-scanning direction and the lengths of the margins.

Next, when it is assumed that the sheet P where printing is being carried out reaches the current transport target, that is, when it is assumed that the sheet supply motor 34 is rotated to the current transport target, the control section 30 determines whether or not the sheet P which is the next sheet has reached $D_1$ which is the contact point of the relay roller 12*a* and the driven roller 12*b* (S311). Here, that the sheet P which is the next sheet has reached $D_1$ which is the contact point of the relay roller 12*a* and the driven roller 12*b* is the same as that the relay rollers have started to send out the sheet P which is the $n^{th}$ (last) sheet. Accordingly, due to this determination, it is clear whether or not there is a state where it is possible to transport the sheet P which is the last sheet to the print section 20 without driving the pickup roller 11 due to the sheet P where printing is being carried out having reached the current transport target.

The control section 30 determines whether or not the rear edge of the sheet where printing is currently being carried out has reached $D_5$ which is the detection position of the sheet sensor 43 (S312) when the sheet supply motor 34 is rotated to the current transport target in a case where it is determined that the sheet P which is the last sheet has not reached $D_1$ which is the contact point of the relay roller 12*a* and the driven roller 12*b* even when the sheet supply motor 34 is rotated to the current transport target. Here, activating of continuous sheet supply printing until the $n-2^{th}$ sheet, sheet supply printing of the $n-1^{th}$ sheet, and printing of the $n^{th}$ sheet are at points in time when the front edge of the sheet P has reached the detection position of the sheet sensor 43. Accordingly, when the sheet supply motor 34 is rotated to the current transport target, it may be determined whether or not the front edge of the sheet P which is the next sheet has reached the detection position of the sheet sensor 43 and not whether or not the rear edge of the sheet P where printing is currently being carried out has reached $D_5$ which is the detection position of the sheet sensor 43.

The sheet transporting is completed by the control section 30 driving the sheet supply motor 34 to the current transport target (S313) in a case where it is determined that the rear edge of the sheet P where printing is currently being carried out has not reached $D_5$ which is the detection position of the sheet sensor 43 even when the sheet supply motor 34 is rotated to the current transport target. At this time, the relay rollers 12*a* and 13*a*, the sheet feeding roller 14*a*, and the sheet discharge roller 15*a* are driven when the sheet supply motor 34 is rotated. In addition, if transferring of the driving force from the sheet supply motor 34 to the pickup roller 11 has already been stopped, the pickup roller 11 is not driven even when the sheet supply motor 34 is rotated. In addition, if transferring of the driving force from the sheet supply motor 34 to the pickup roller 11 has not yet stopped, the pickup roller 11 is also driven when the sheet supply motor 34 is rotated.

The pickup roller 11 is rotated along with the sheet P which is the $n^{th}$ sheet since the sheet P which is the $n^{th}$ sheet is sent out by the relay roller 12*a* if the sheet supply motor 34 is rotated in a case where the pickup roller 11 and the relay roller 12*a* come into contact with the same sheet P which is the $n^{th}$ sheet even in a state where the driving force of the sheet supply motor 34 is not transferred to the pickup roller 11. On the other hand, the sheet P which is the $n+1^{th}$ sheet is not drawn out from the sheet supply cassette 50 since the pickup roller 11 is not rotated in a case where rear edge of the sheet P which is the $n^{th}$ sheet which is sent out by the relay roller 12*a* has already passed the pickup roller 11 in a state where the driving force of the sheet supply motor 34 is not transferred to the pickup roller 11.

Therefore, the control section 30 rotates the sheet supply motor 34 to the current transport target in step S313 after the pickup roller off flag is turned on (S318) in a case where it is determined that the sheet P which is the last sheet has reached $D_1$ which is the contact point of the relay roller 12*a* and the driven roller 12*b* in step S311 when the sheet supply motor 34 is rotated to the current transport target.

As will be described next, the control section 30 executes splitting the process of transporting into two part of prior transporting where the rear edge of the sheet P where printing is currently being carried out has not reached the sheet sensor 43 and latter transporting where the rear edge of the sheet P where printing is currently being carried out has passed the sheet sensor 43 as well as stopping transferring of the driving force from the sheet supply motor 34 to the pickup roller 11 between the prior transporting and the latter transporting in a case where it is determined that the rear edge of the sheet P where printing is currently being carried out has reached $D_5$ which is the detection position of the sheet sensor 43 when the sheet supply motor 34 is rotated to the current transport target.

In detail, first, the control section 30 drives the sheet supply motor 34 by setting the transport target in the prior transporting to immediately before the rear edge of the sheet P where printing is currently being carried out reaches $D_5$ which is the detection position of the sheet sensor 43 (S314). In the prior transporting, the pickup roller 11, the relay rollers 12*a* and 13*a*, the sheet feeding roller 14*a*, and the sheet discharge roller 15*a* are driven by the sheet supply motor 34 since the driving force is transferred from the sheet supply motor 34 to the pickup roller 11.

When the sheet supply motor 34 is stopped due to the rear edge of the sheet P where printing is currently being carried out reaching immediately before $D_5$ which is the detection position of the sheet sensor 43, the control section 30 stops transferring of the driving force from the sheet supply motor 34 to the pickup roller 11 (S315) by moving the switching mechanism 19 along with the carriage 21 by driving the carriage motor 32.

When transferring of the driving force from the sheet supply motor 34 to the pickup roller 11 is stopped, the control section 30 drives the sheet supply motor 34 (S316) by setting the current transport target with regard to the sheet P which is the $n-1^{th}$ sheet as the transport target in the latter printing. In the latter transporting, the sheet which is the $n+1^{th}$ sheet, where printing is not carried out in the print job which is currently being executed, is not drawn out by the pickup roller 11 since the driving force from the sheet supply motor 34 to the pickup roller 11 is not transferred. Then, in the latter transporting, since the sheet P which is the $n^{th}$ (last) sheet has already been transferred to $D_1$ which is the contact point of the relay roller 12*a* and the driven roller 12*b*, the sheet P which is the $n^{th}$ sheet is reliably transported to the print section 20 by the relay rollers 12*a* and 13*a* even without the driving force being transferred from the sheet supply motor 34 to the pickup roller 11.

Figure 6:
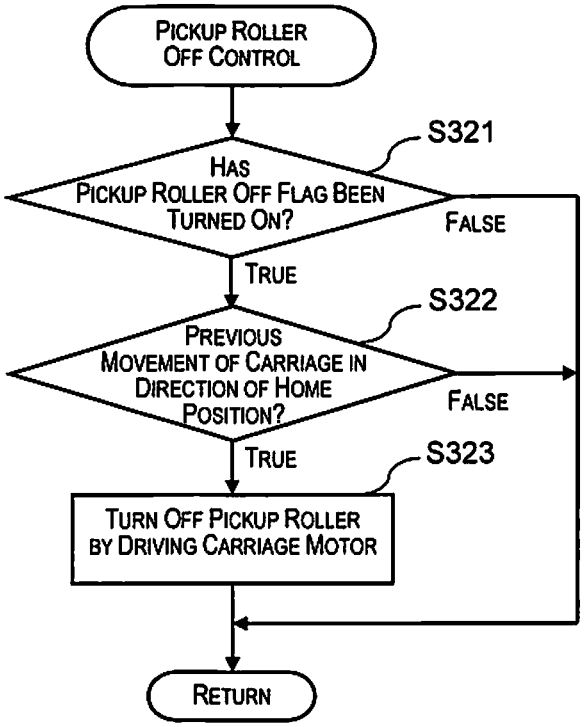
FIG. 6 is a flow chart related to an embodiment of the present invention.

Next, pickup roller off control which is executed in step S33 which is shown in FIG. 4 will be described in detail with reference to FIG. 6.

Initially, the control section 30 determines if the pickup roller off flag is on or off (S321). In a case where it is determined that the pickup roller off flag is off, the control section 30 completes pickup roller off control without stopping transferring of the driving force from the sheet supply motor 34 to the pickup roller 11.

In a case where the pickup roller off flag is on, the control section 30 determines whether or not the movement direction of the carriage 21 during the previous printing is a direction of approaching the home position (a direction of approaching the switching mechanism 19) (S322). That is, it is determined in which direction the carriage 21 is moving when ink is being discharged in step S32 which is shown in FIG. 4 which is carried out immediately beforehand. In a case where it is determined that the movement direction of the carriage 21 during the previous printing is not a direction of approaching the home position, the control section 30 completes pickup roller off control without stopping transferring of the driving force from the sheet supply motor 34 to the pickup roller 11.

In a case where it is determined that the movement direction of the carriage 21 during the previous printing is a direction of approaching the home position (a direction of approaching the switching mechanism 19), the control section 30 stops transferring of the driving force from the sheet supply motor 34 to the pickup roller 11 (S323) by moving the carriage motor 32 to abut with the switching mechanism 19 in the same direction as during the previous printing by driving the carriage motor 32 and further moving the switching mechanism 19 along with the carriage 21. That is, in pickup roller off control, the transfer path of the driving force from the sheet supply motor 34 to the pickup roller 11 is interrupted and, as a result, transferring of the driving force from the sheet supply motor 34 to the sheet P which is the $n^{th}$ sheet is stopped only in a case where the movement direction of the carriage 21 during the previous printing is a direction of approaching the switching mechanism 19. Then, the carriage motor 32 is not driven and the carriage 21 does not move to the switching mechanism 19 in a case where the movement direction of the carriage 21 during the previous printing is a direction of moving away from the switching mechanism 19. As a result, it is possible to shorten time for printing by suppressing the movement distance of the carriage 21 which is performed in order to stop transferring of the driving force from the sheet supply motor 34 to the sheet P which is the $n^{th}$ sheet.

Using the printer 1 described above, in a case where the printing media are transported in the continuous transport mode in the print job with n sheets, the sheet P which is the $n+1^{th}$ sheet which is not used in the print job is not drawn out by the pickup roller 11 irrespective of the length of the printing media and the transport distance since transferring of the driving force from the sheet supply motor 34 to the pickup roller 11 is stopped before the pickup roller 11 completes drawing out of the sheet P which is the last sheet which belongs to the print job from the sheet supply cassette 50. In addition, it is possible to continuously transport all of the sheets P which are used in the print job to the print section 20 since transferring of the driving force from the sheet supply motor 34 to the pickup roller 11 is stopped after the relay roller 12*a* starts drawing out of the sheet P which is the last sheet.

In addition, it is not possible for the control section 30 to stop the pickup roller since the control section 30 does not carry out switching of the switching mechanism 19 using movement of the carriage 21 in a case where it is determined that the movement direction of the carriage 21 during the previous printing is not a direction of approaching the home position even when the pickup roller off flag is on. In this state, it is possible for the control section 30 to stop the pickup roller by carrying out switching of the switching mechanism 19 using movement of the carriage 21 if the next printing has been executed and the movement direction of the carriage 21 during the previous printing is a direction of approaching the home position. However, the control section 30 still does not carry out switching of the switching mechanism 19 using movement of the carriage 21 in a case where only transporting of the sheet P is carried out without the next printing being executed. In a case such as this, the sheet P which is the $n+1^{th}$ sheet which is not used in the print job is not drawn out by the pickup roller 11 if switching of the switching mechanism 19 is carried out according to it being determined that the rear edge of the sheet P where printing is currently being carried out reaches $D_5$ which is the detection position of the sheet sensor 43 when the sheet supply motor 34 is rotated to the current transport target.

4. Other Embodiments

Here, the technical scope of the present invention is not limited by the embodiment described above and it is clear that various modifications are possible in the scope which does not depart from the gist of the present invention.

In the embodiment described above, transferring of the driving force from the sheet supply motor 34 to the pickup roller 11 is stopped during execution of sheet supply printing with regard to the sheet P which is the second to last sheet of the print job (the $n-1^{th}$ sheet in the print job with n sheets), but whether to stop transferring of the driving force from the sheet supply motor 34 to the pickup roller 11 during execution of sheet supply printing with regard to the sheet P which is any number sheet before the last sheet of the print job may be set according to the length of the transport path. That is, when the transport distance of the sheet P from the pickup roller 11 to the print section 20 is X, the interval between the sheets P which line up and are transported as preceding and succeeding sheets in the continuous transport mode is Y, the length of the sheet P is Z, and N is a quotient X/(Y+Z), the control section 30 may stop transferring of the driving force from the sheet supply motor 34 to the pickup roller 11 before the rear edge of the sheet P which is the $(n-N)^{th}$ sheet reaches the print section 20. Then, the number of relay rollers is not limited to two, may be one or three or more, and may be set to a number according to the length of the transport path.

In addition, transferring of the driving force from the sheet supply motor 34 to the pickup roller 11 may be stopped at any timing during a period when the pickup roller 11 draws out the sheet P which is the last sheet of the print job if it is after the relay roller 12*a* has started to send out the sheet P which is the last sheet. In addition, transferring of the driving force from the sheet supply motor 34 to the pickup roller 11 may be stopped normally in step S315 by, for example, reversing the processing order of step S311 and step S312 which are shown in FIG. 5 or omitting the processes of steps S33, S311, and S318.

In addition, instead of stopping transferring of the driving force from the sheet supply motor 34 to the pickup roller 11, transferring of the driving force of the sheet supply motor 34 from the pickup roller 11 to the sheet P may be stopped by separating the pickup roller 11 from the sheet P by moving the pickup roller 11. In addition, the switching mechanism may be driven by an actuator which is different from the carriage motor 32.

In addition, a printing mechanism such as a line ink jet printer, a laser printer, a heat transfer printer, or the like may be used as the print section. In addition, the edge of the sheet may be detected using a non-contact sensor other than an optical sensor, the edge of the sheet may be detected using a contact sensor, or displacement of the sheet may be measured using only the rotary encoder of the sheet supply motor. In addition, as the actuator which drives the transport roller, a stepping motor may be used or a servomotor may be used.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A printer comprising:

a media stacking section where printing media are stacked;

a print section including a transport roller configured and arranged to transport the printing media and a print head configured and arranged to print on the printing media which are transported by the transport roller;

a pickup roller configured and arranged to draw out the printing media from the media stacking section;

a relay roller arranged at a position between the pickup roller and the transport roller, and configured and arranged to send out the printing media drawn out by the pickup roller to the print section;

a common actuator configured and arranged to drive the pickup roller, the relay roller, and the transport roller;

a transport mechanism section configured and arranged to transfer driving force of the common actuator to the printing media via the pickup roller, the relay roller, and the transport roller; and a control section configured to control the common actuator based on a print job and displacement of the printing media where, in a period of time when printing is being carried out on one of the printing media by the print section, other printing media are transported using the pickup roller and the relay roller in a continuous transport mode, the control section being configured to stop transferring of the driving force of the common actuator from the pickup roller to an $n^{th}$ printing medium after the pickup roller draws out the nth printing medium and the relay roller starts to send out the $n^{th}$ printing medium which is drawn out in a case where the print job, where printing is carried out on n of the printing media (where n is an integer of two or more) with a length in a transport direction shorter than a transport distance of the printing media from the pickup roller to the print section, is processed in the continuous transport mode, and when the transport distance of the printing media from the pickup roller to the print section is X, an interval between the printing media which line up and are transported as preceding and succeeding printing media in the continuous transport mode is Y, the length of the printing media in the transport direction is Z, and N is a quotient X/(Y+Z), the control section being configured to stop transferring of the driving force of the common actuator from the pickup roller to the $n^{th}$ printing medium before a rear edge of an $(n-N)^{th}$ printing medium reaches the print section.

2. The printer according to claim 1, further comprising a measuring section configured and arranged to measure displacement of the printing media, wherein the measuring section includes a sensor configured and arranged to detect passing of an edge of the printing media at a position between the relay roller and the transport roller, and the control section is configured to drive the transport roller with the position where the sensor detects the edge of the printing media as a reference, to alternately repeat transporting of the printing media using the transport roller and driving of the print head, to determine whether or not the $n^{th}$ printing medium has reached the position of being sent out by the relay roller when the one of the printing media is in the process of being transported, to determine whether or not the rear edge of the one of the printing media has passed the sensor when the one of the printing media is in the process of being transported in a case when it is determined that the $n^{th}$ printing medium has not reached the position of being sent out by the relay roller even when the one of the printing media is in the process of being transported, and to execute splitting the process of being transported into two part of prior transporting where the rear edge of the one of the printing media has not reached the sensor and latter transporting where the rear edge of the one of the printing media has passed the sensor as well as stopping transferring of the driving force of the common actuator from the pickup roller to the $n^{th}$ printing medium between the prior transporting and the latter transporting in a case when it is determined that the rear edge of the one of the printing media has passed the sensor when the one of the printing media is in the process of being transported.

3. The printer according to claim 2, wherein the print section includes a carriage configured and arranged to move back and forth in a direction which is orthogonal to the transport direction of the printing media with the print head which discharges ink droplets being mounted on the carriage, the transport mechanism section includes a switching mechanism configured and arranged to switch between a state where the driving force is transferred from the common actuator to the pickup roller and a state where the driving force is not transferred from the common actuator to the pickup roller by interrupting transfer of the driving force from the common actuator to the pickup roller by abutting with the carriage at a prescribed position and moving along with the carriage, and the control section is configured to stop transferring of the driving force of the common actuator to the pickup roller by moving the carriage to pass the prescribed position.

4. The printer according to claim 3, wherein the control section is configured to discharge ink droplets from the print head in both of a first period when the carriage is moved in a first direction and a second period when the carriage is moved in a second direction which is an opposite orientation to the first direction, to set a stopping flag in a case where it is determined that the $n^{th}$ printing medium reaches the position of being sent out by the relay roller when the one of the printing media is in the process of being transported, to determine whether or not a movement direction of the carriage when transporting the current and previous one of the printing media is a direction where the carriage is approaching the switching mechanism when the one of the printing media in the process of being transported, and to move the carriage to pass the prescribed position before the one of the printing media in the process of being transported is transported in a case where it is determined that the movement direction of the carriage is a direction where the carriage is approaching the switching mechanism.

5. A control method for a printer including a media stacking section where printing media are stacked, a print section including a transport roller which transports the printing media and a print head which prints on the printing media which are transported by the transport roller, a pickup roller which draws out the printing media from the media stacking section, a relay roller which is arranged at a position between the pickup roller and the transport roller and sends out the printing media which are drawn out by the pickup roller to the print section, a common actuator which drives the pickup roller, the relay roller, and the transport roller, and a transport mechanism section which transfers driving force of the common actuator to the printing media via the pickup roller, the relay roller, and the transport roller, the control method comprising:

controlling the common actuator based on a print job and displacement of the printing media;

transporting other printing media using the pickup roller and the relay roller in a continuous transport mode in a period of time when printing is being carried out on one of the printing media by the print section; and stopping transferring of the driving force of the common actuator from the pickup roller to an $n^{th}$ printing medium after the pickup roller draws out the $n^{th}$ printing medium and the relay roller starts to send out the $n^{th}$ printing medium which is drawn out in a case where the print job, where printing is carried out on n of the printing media (where n is an integer of two or more) with a length in the transport direction shorter than a transport distance of the printing media from the pickup roller to the print section, is processed in the continuous transport mode, and when the transport distance of the printing media from the pickup roller to the print section is X, an interval between the printing media which line up and are transported as preceding and succeeding printing media in the continuous transport mode is Y, the length of the printing media in the transport direction is Z, and N is a quotient X/(Y+Z), the transferring of the driving force of the common actuator from the pickup roller to the $n^{th}$ printing medium being stopped before a rear edge of an $(n-N)^{th}$ printing medium reaches the print section.

6. A printer comprising:

a media stacking section where printing media are stacked;

a print section including a transport roller configured and arranged to transport the printing media and a print head configured and arranged to print on the printing media which are transported by the transport roller;

a pickup roller configured and arranged to draw out the printing media from the media stacking section;

a relay roller arranged at a position between the pickup roller and the transport roller, and configured and arranged to send out the printing media drawn out by the pickup roller to the print section;

a common actuator configured and arranged to drive the pickup roller, the relay roller, and the transport roller;

a transport mechanism section configured and arranged to transfer driving force of the common actuator to the printing media via the pickup roller, the relay roller, and the transport roller; and a control section configured to control the common actuator based on a print job and displacement of the printing media where, in a period of time when printing is being carried out on one of the printing media by the print section, other printing media are transported using the pickup roller and the relay roller in a continuous transport mode, the control section being configured to stop transferring of the driving force of the common actuator from the pickup roller to an $n^{th}$ printing medium after the pickup roller draws out the nth printing medium and the relay roller starts to send out the $n^{th}$ printing medium which is drawn out in a case where the print job, where printing is carried out on n of the printing media (where n is an integer of two or more) with a length in a transport direction shorter than a transport distance of the printing media from the pickup roller to the print section, is processed in the continuous transport mode, and the control section being configured to split transporting of the printing media into two parts of prior transporting in which a rear edge of the printing media where printing is currently being carried out has not reached a prescribed position and latter transporting in which the rear edge of the printing media where printing is currently being carried out has passed the prescribed position, and stop transferring of the driving force of the common actuator to the pickup roller between the prior transporting and the latter transporting.

7. A control method for a printer including a media stacking section where printing media are stacked, a print section including a transport roller which transports the printing media and a print head which prints on the printing media which are transported by the transport roller, a pickup roller which draws out the printing media from the media stacking section, a relay roller which is arranged at a position between the pickup roller and the transport roller and sends out the printing media which are drawn out by the pickup roller to the print section, a common actuator which drives the pickup roller, the relay roller, and the transport roller, and a transport mechanism section which transfers driving force of the common actuator to the printing media via the pickup roller, the relay roller, and the transport roller, the control method comprising:

controlling the common actuator based on a print job and displacement of the printing media;

transporting other printing media using the pickup roller and the relay roller in a continuous transport mode in a period of time when printing is being carried out on one of the printing media by the print section; and stopping transferring of the driving force of the common actuator from the pickup roller to an $n^{th}$ printing medium after the pickup roller draws out the $n^{th}$ printing medium and the relay roller starts to send out the $n^{th}$ printing medium which is drawn out in a case where the print job, where printing is carried out on n of the printing media (where n is an integer of two or more) with a length in the transport direction shorter than a transport distance of the printing media from the pickup roller to the print section, is processed in the continuous transport mode, and the transporting of the printing media being split into two parts of prior transporting in which a rear edge of the printing media where printing is currently being carried out has not reached a prescribed position and latter transporting in which the rear edge of the printing media where printing is currently being carried out has passed the prescribed position, and the transferring of the driving force of the common actuator to the pickup roller being stopped between the prior transporting and the latter transporting.

* * * * *